US009014588B2

(12) United States Patent
Hamada

(10) Patent No.: US 9,014,588 B2
(45) Date of Patent: Apr. 21, 2015

(54) IMAGE FORMING APPARATUS

(71) Applicant: Fuji Xerox Co., Ltd., Minato-ku, Tokyo (JP)

(72) Inventor: Hirofumi Hamada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 79 days.

(21) Appl. No.: 13/765,926

(22) Filed: Feb. 13, 2013

(65) Prior Publication Data

US 2014/0023384 A1 Jan. 23, 2014

(30) Foreign Application Priority Data

Jul. 20, 2012 (JP) ..... 2012-161224

(51) Int. Cl.
*G03G 21/00* (2006.01)
*G03G 15/16* (2006.01)

(52) U.S. Cl.
CPC ..... *G03G 21/0011* (2013.01); *G03G 15/161* (2013.01)

(58) Field of Classification Search
USPC ..... 399/71
See application file for complete search history.

(56) References Cited

U.S. PATENT DOCUMENTS 6,226,463 B1 * 5/2001 Phillips et al. ..... 399/24
2005/0100369 A1 * 5/2005 Park et al. ..... 399/302

FOREIGN PATENT DOCUMENTS

JP 2002-108161 A 4/2002
JP 2002-244485 A 8/2002
JP 2005-049437 A 2/2005
JP 2006-138925 A 6/2006
JP 2008111885 A * 5/2008

* cited by examiner

*Primary Examiner* — Clayton E Laballe
*Assistant Examiner* — Leon W Rhodes, Jr.
(74) *Attorney, Agent, or Firm* — Sughrue Mion, PLLC

(57) ABSTRACT

An image forming apparatus includes image forming devices which each forms a developer image on a latent image carrier, transfers the developer image onto an intermediate transfer member, and cleans the latent image carrier by using a plate-shaped cleaning member, the intermediate transfer body, and a controller. The developer used in one of the image forming devices is a low-electrostatic-propensity developer having an electrification performance lower than those of the developers used in the other image forming devices. The controller has a control mode for executing a supply operation in which the low-electrostatic-propensity developer used in the one of the image forming devices is transferred onto the intermediate transfer body and at least a part of the low-electrostatic-propensity developer is reversely transferred onto the latent image carriers of the other image forming devices and caused to reach the respective plate-shaped cleaning members.

12 Claims, 14 Drawing Sheets

IMAGE FORMING APPARATUS

CROSS-REFERENCE TO RELATED APPLICATIONS

This application is based on and claims priority under 35 USC 119 from Japanese Patent Application No. 2012-161224 filed Jul. 20, 2012.

BACKGROUND (i) Technical Field

The present invention relates to an image forming apparatus.

(ii) Related Art

Image forming apparatuses, such as printers, copying machines, and facsimile machines, that use an image recording method such as an electrophotographic method or an electrostatic recording method generally form an image by transferring a developer image onto a recording medium, such as a sheet of recording paper. The developer image is formed by developing, with developer, an electrostatic latent image formed on a surface of a latent image carrier, such as a photoconductor. Such an image forming apparatus includes a cleaning device that cleans a surface of the latent image carrier after the transferring process by bringing a plate-shaped cleaning member, such as a rubber blade, into contact with the surface and scraping off the developer that remains on the surface after the transferring process.

SUMMARY

According to an aspect of the invention, there is provided an image forming apparatus including plural image forming devices arranged along a line, each image forming device forming a developer image with a developer on a surface of a latent image carrier that rotates in a rotation direction, transferring the developer image onto an intermediate transfer member, and cleaning the surface of the latent image carrier by bringing at least a plate-shaped cleaning member into contact with the surface of the latent image carrier after the transferring of the developer image and scraping off the developer that remains on the surface of the latent image carrier after the transferring of the developer image; the intermediate transfer body that rotates so as to successively pass through transfer positions of the latent image carriers of the image forming devices and that carries and transports the developer images transferred onto the intermediate transfer body from the latent image carriers; and a controller that controls operations of the image forming devices and the intermediate transfer body. The developer used in one of the image forming devices is a low-electrostatic-propensity developer having an electrification performance lower than electrification performances of the developers used in the other image forming devices. The controller has a control mode for executing a supply operation in which the low-electrostatic-propensity developer used in the one of the image forming devices is transferred onto the intermediate transfer body and at least a part of the low-electrostatic-propensity developer is reversely transferred onto the latent image carriers of the image forming devices other than the one of the image forming devices and caused to reach the respective plate-shaped cleaning members.

BRIEF DESCRIPTION OF THE DRAWINGS

Exemplary embodiments of the present invention will be described in detail based on the following figures, wherein:

FIGS. 7A and 7B schematically illustrate the operational state of the supply operation, wherein FIG. 7A illustrates an operation of forming a developer-supplying toner image and the supply status of a first transfer voltage and FIG. 7B illustrates the manner in which a low-electrostatic-propensity developer is reversely transferred in downstream image forming devices;

FIGS. 9A and 9B schematically illustrate the operational state of the supply operation performed in the later period, wherein FIG. 9A illustrates the manner in which photoconductor drums are rotated in a reverse direction in a recovery operation and FIG. 9B illustrates the operational state of the supply operation performed after the recovery operation;

DETAILED DESCRIPTION

Exemplary embodiments of the present invention will now be described with reference to the drawings.

First Exemplary Embodiment

Figure 1:
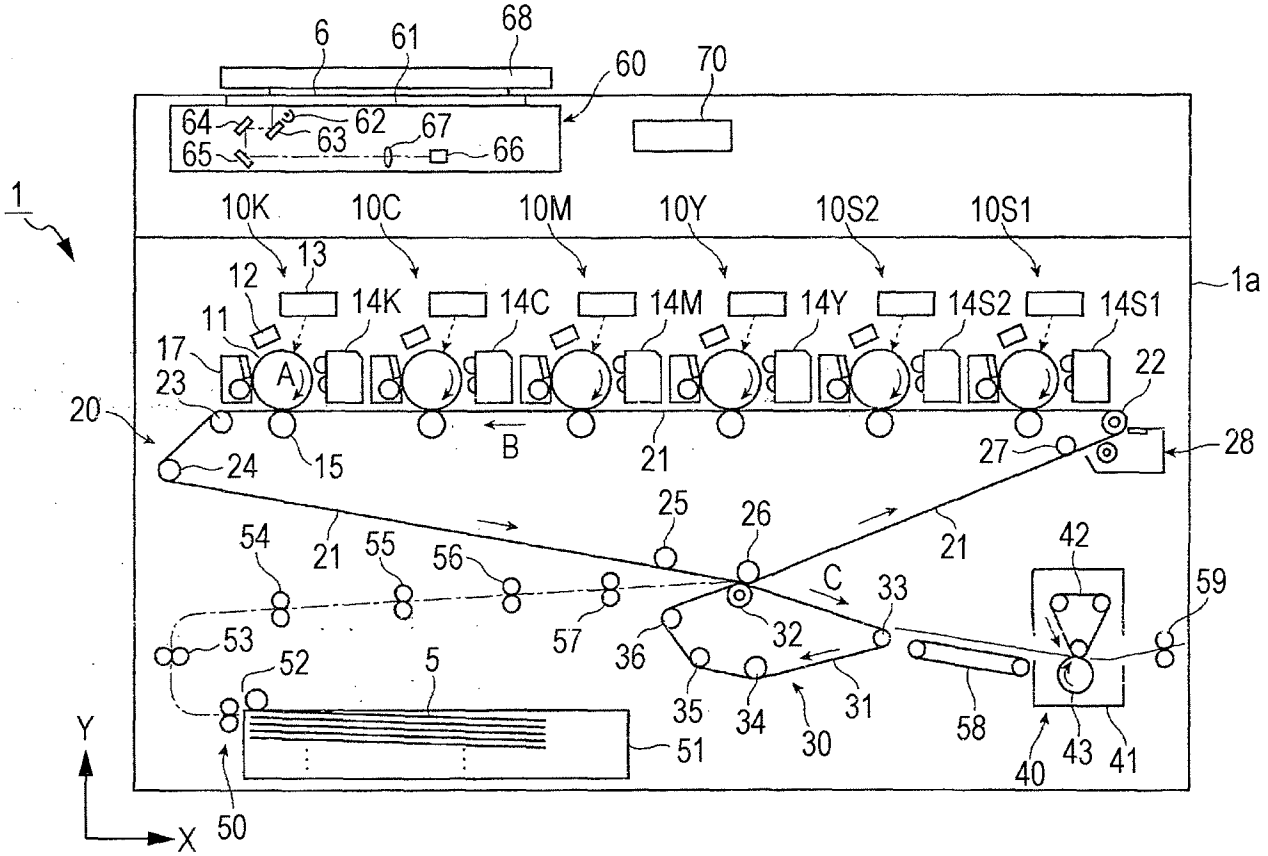
FIG. 1 illustrates an image forming apparatus including developing devices according to a first exemplary embodiment.
Figure 2:
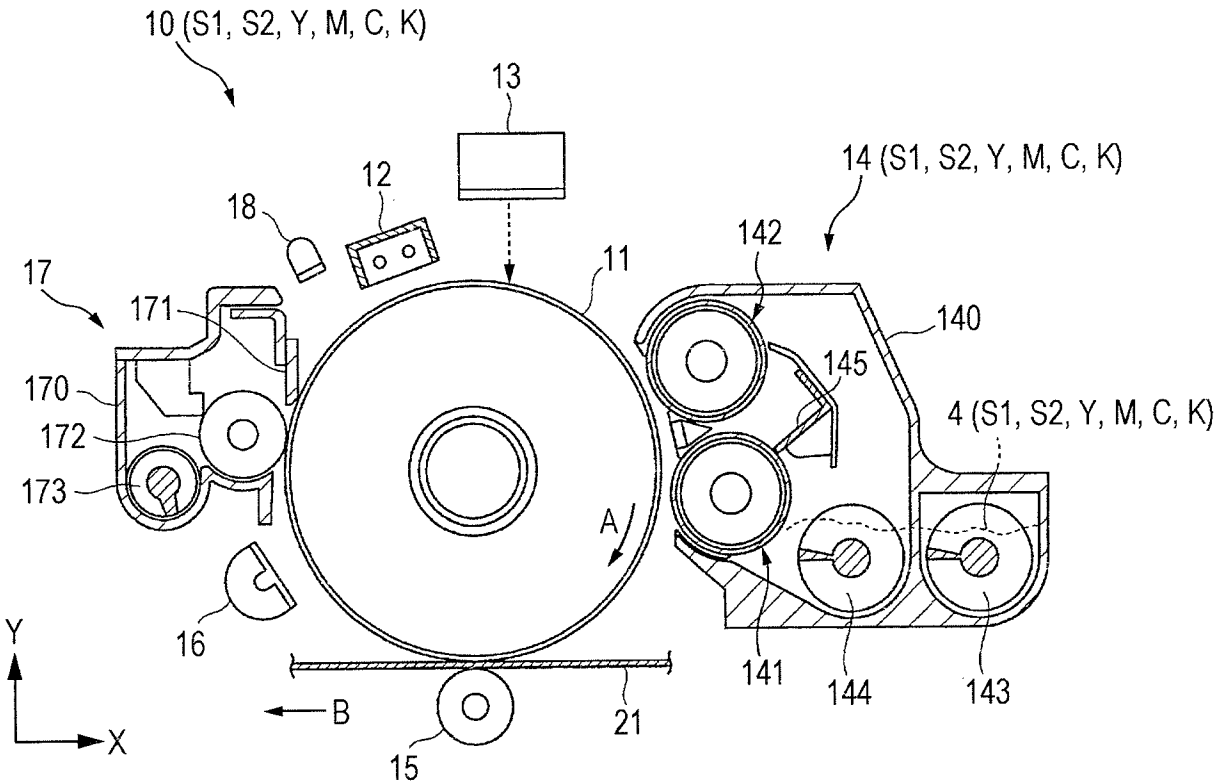
FIG. 2 is a partially sectioned view of a part including an image forming device of the image forming apparatus illustrated in FIG. 1.

FIGS. 1 and 2 illustrate an image forming apparatus 1 according to a first exemplary embodiment. FIG. 1 illustrates the overall structure of the image forming apparatus 1, and FIG. 2 illustrates an enlarged view of a part (for example, image forming devices) of the image forming apparatus 1.

Overall Structure of Image Forming Apparatus

The image forming apparatus 1 according to the first exemplary embodiment is, for example, a color printer. The image forming apparatus 1 includes plural image forming devices 10, an intermediate transfer device 20, a paper feeding device 50, and a fixing device 40. Each image forming device 10 forms a toner image developed with toner contained in developer 4. The intermediate transfer device 20 carries toner images formed by the respective image forming devices 10 and transports the toner images to a second transfer position at which the toner images are transferred onto a sheet of recording paper 5, which is an example of a recording medium, in a second transfer process. The paper feeding device 50 contains and transports the sheet of recording paper 5 to be supplied to the second transfer position of the intermediate transfer device 20. The fixing device 40 fixes the toner images that have been transferred onto the sheet of recording paper 5 by the intermediate transfer device 20 in the second transfer process.

In the case where, for example, an image input device 60 that inputs a document image to be formed on the sheet of recording paper 5 is additionally provided, the image forming apparatus 1 may be configured as a color copier. Referring to FIG. 1, the image forming apparatus 1 includes a housing 1*a* including, for example, a supporting structural member and an external covering part. The one-dot chain line shows a transport path along which the sheet of recording paper 5 is transported in the housing 1*a*.

Structure of Part of Image Forming Apparatus

The image forming devices 10 include six image forming devices 10Y, 10M, 10C, 10K, 10S1, and 10S2. The image forming devices 10Y, 10M, 10C, and 10K respectively form toner images of four colors, which are yellow (Y), magenta (M), cyan (C), and black (K). The image forming devices 10S1 and 10S2 respectively form two types of toner images of special colors S1 and S2. The six image forming devices 10 (S1, S2, Y, M, C, and K) are arranged along a line in the inner space of the housing 1*a*. The developers 4 (S1 and S2) of the special colors (S1 and S2) contain, for example, materials of colors which are difficult or impossible to be expressed by the above-described four colors. More specifically, toners of colors other than the four colors, toners having the same colors as the four colors but saturations different from those of the toners of four colors, clear toners that increase the glossiness, foaming toners used in Braille printing, fluorescent toners, etc., may be used. The image forming devices 10 (S1, S2, Y, M, C, and K) have a substantially similar structure, as described below, except for the type of the developer used therein.

As illustrated in FIGS. 1 and 2, each image forming device 10 (S1, S2, Y, M, C, or K) includes a photoconductor drum 11 that rotates, and devices described below are arranged around the photoconductor drum 11. The devices include a charging device 12, an exposure device 13, a developing device 14 (S1, S2, Y, M, C, K), a first transfer device 15, a pre-cleaning charging device 16, a drum cleaning device 17, and a electricity removing device 18. The charging device 12 charges a peripheral surface (image carrying surface) of the photoconductor drum 11, on which an image may be formed, to a certain potential. The exposure device 13 irradiates the charged peripheral surface of the photoconductor drum 11 with light LB based on image information (signal) to form an electrostatic latent image (for the corresponding color) having a potential difference. The developing device 14 (S1, S2, Y, M, C, or K) forms a toner image by developing the electrostatic latent image with toner contained in the developer 4 of the corresponding color (S1, S2, Y, M, C, or K). The first transfer device 15 performs a first transfer process in which the toner image is transferred onto the intermediate transfer device 20. The pre-cleaning charging device 16 charges substances, such as toner, that remain on the image carrying surface of the photoconductor drum 11 after the first transfer process. The drum cleaning device 17 cleans the image carrying surface by removing the recharged substances. The electricity removing device 18 removes electricity from the image carrying surface of the photoconductor drum 11 after the cleaning process.

The photoconductor drum 11 includes a cylindrical or columnar base member that is grounded and a photoconductive layer (photosensitive layer) that is provided on the peripheral surface of the base member. The photoconductive layer is made of a photosensitive material and is provided with the image carrying surface. The photoconductor drum 11 is supported so as to be capable of rotating in the direction shown by arrow A when power is transmitted thereto from a rotation driving device (not shown).

The charging device 12 is a non-contact charging device, such as a corona discharger, and is arranged without contacting the photoconductor drum 11. The charging device 12 includes a discharge member that receives a charging voltage. In the case where the developing device 14 performs reversal development, a voltage or current having the same polarity as the charging polarity of the toner supplied by the developing device 14 is supplied as the charging voltage.

The exposure device 13 forms the electrostatic latent image by irradiating the charged peripheral surface of the photoconductor drum 11 with light (arrowed dashed line) LB generated in accordance with the image information input to the image forming apparatus 1. When forming the electrostatic latent image, the exposure device 13 receives the image information (signal) that is input to the image forming apparatus 1 by any method.

As illustrated in FIG. 2, each developing device 14 (S1, S2, Y, M, C, or K) includes a housing 140 having an opening and a chamber of the developer 4. Two developing rollers 141 and 142, two stirring-and-transporting members 143 and 144, and a layer-thickness regulating member 145 are disposed in the housing 140. The two developing rollers 141 and 142 hold the developer 4 and transport the developer 4 to respective developing areas in which the developing rollers 141 and 142 face the photoconductor drum 11. The stirring-and-transporting members 143 and 144 are, for example, two screw augers that transport the developer 4 while stirring the developer 4 so that the developer 4 passes between the developing rollers 141 and 142. The layer-thickness regulating member 145 regulates the amount (layer thickness) of the developer 4 held by the developing roller 142. A developing voltage supplied from a power supply device (not shown) is applied between the photoconductor drum 11 and the developing rollers 141 and 142 of the developing device 14. The developing rollers 141 and 142 and the stirring-and-transporting members 143 and 144 receive power from a rotation driving device (not shown) and rotates in a certain direction. Two-component developers containing nonmagnetic toner and magnetic carrier are used as the developers 4 (Y, M, C, and K) of the above-described four colors and the developers 4 (S1 and S2) of the two special colors.

The first transfer device 15 is a contact transfer device including a first transfer roller which rotates while contacting the peripheral surface of the photoconductor drum 11 and receives a first transfer voltage. A direct-current voltage having a polarity opposite to the charging polarity of the toner is supplied as the first transfer voltage from the power supply device (not shown).

As illustrated in FIG. 2, the drum cleaning device 17 includes a container-shaped body 170 that has an opening, a cleaning plate 171, a rotating brush roller 172, and a transporting member 173. The cleaning plate 171 is arranged to contact the peripheral surface of the photoconductor drum 11 at a certain pressure after the first transfer process and clean the peripheral surface of the photoconductor drum 11 by removing substances such as residual toner therefrom. The rotating brush roller 172 is arranged to contact with the peripheral surface of the photoconductor drum 11 while rotating at a position upstream of the cleaning plate 171 in the rotation direction of the photoconductor drum 11. The transporting member 173 is, for example, a screw auger that transports the substances such as toner that have been removed by the cleaning plate 171 to a collecting system (not shown). The cleaning plate 171 may be formed of a plate-shaped member (for example, a blade) made of rubber or the like.

As illustrated in FIG. 1, the intermediate transfer device 20 is disposed below the image forming devices 10 (S1, S2, Y, M, C, and K). The intermediate transfer device 20 basically includes an intermediate transfer belt 21, plural belt support rollers 22 to 27, a second transfer device 30, and a belt cleaning device 28. The intermediate transfer belt 21 rotates in the direction shown by arrow B while passing through a first transfer position, which is between the photoconductor drum 11 and the first transfer device 15 (first transfer roller). The belt support rollers 22 to 27 retain the intermediate transfer belt 21 in a desired position at the inner surface of the intermediate transfer belt 21 so that the intermediate transfer belt 21 is rotatably supported. The second transfer device 30 is disposed to oppose the belt support roller 26 that supports the intermediate transfer belt 21 at the outer-peripheral-surface (image-carrying-surface) side of the intermediate transfer belt 21. The second transfer device 30 performs a second transfer process in which the toner images on the intermediate transfer belt 21 are transferred onto the sheet of recording paper 5. The belt cleaning device 28 cleans the outer peripheral surface of the intermediate transfer belt 21 by removing substances such as toner and paper dust that remain on the outer peripheral surface of the intermediate transfer belt 21 after the intermediate transfer belt 21 has passed the second transfer device 30.

The intermediate transfer belt 21 may be, for example, an endless belt made of a material obtained by dispersing a resistance adjusting agent, such as carbon black, in a synthetic resin, such as polyimide resin or polyamide resin. The belt support roller 22 serves as a driving roller. The belt support rollers 23, 25, and 27 serve as driven rollers for retaining the position of the intermediate transfer belt 21. The belt support roller 24 serves as a tension-applying roller. The belt support roller 26 serves as a back-up roller in the second transfer process.

As illustrated in FIG. 1, the second transfer device 30 includes a second transfer belt 31 and plural support rollers 32 to 36. The second transfer belt 31 rotates in the direction shown by arrow C while passing through a second transfer position, which is on the outer-peripheral-surface side of the intermediate transfer belt 21 that is supported by the belt support roller 26 in the intermediate transfer device 20. The support rollers 32 to 36 retain the second transfer belt 31 in a desired position at the inner surface of the second transfer belt 31 so that the second transfer belt 31 is rotatably supported. The second transfer belt 31 is, for example, an endless belt having substantially the same structure as that of the above-described intermediate transfer belt 21. The belt support roller 32 is arranged so that the second transfer belt 31 is pressed at a certain pressure against the outer peripheral surface of the intermediate transfer belt 21 supported by the belt support roller 26. The belt support roller 32 serves as a driving roller, and the belt support roller 36 serves as a tension-applying roller. The belt support roller 32 of the second transfer device 30 or the belt support roller 26 of the intermediate transfer device 20 receives a direct-current voltage having a polarity that is opposite to or the same as the charging polarity of the toner as a second transfer voltage.

The fixing device 40 includes a heating rotating body 42 including a fixing belt and a pressing rotating body 43 that are arranged in a housing 41 having an inlet and an outlet for the sheet of recording paper 5. The heating rotating body 42 rotates in the direction shown by the arrow and is heated by a heater so that the surface temperature thereof is maintained at a predetermined temperature. The pressing rotating body 43 is drum-shaped and contacts the heating rotating body 42 at a certain pressure substantially along the axial direction of the heating rotating body 42, so that the pressing rotating body 43 is rotated. In the fixing device 40, the contact portion in which the heating rotating body 42 and the pressing rotating body 43 contact each other serves as a fixing process unit that performs a certain fixing process (heating and pressing).

The paper feeding device 50 is disposed below the intermediate transfer device 20 and the second transfer device 30. The paper feeding device 50 basically includes at least one paper container 51 that contains sheets of recording paper 5 of the desired size, type, etc., in a stacked manner and a transporting device 52 that feeds the sheets of recording paper 5 one at a time from the paper container 51. The paper container 51 is, for example, attached to the housing 1*a* such that the paper container 51 may be pulled out therefrom at the front side (side that faces the user during operation) of the housing 1*a*.

Plural pairs of paper transport rollers 53 to 57, which transport each of the sheets of recording paper 5 fed from the paper feeding device 50 to the second transfer position, and a paper transport path including transport guides (not shown) are provided between the paper feeding device 50 and the second transfer device 30. The pair of paper transport rollers 57 that are disposed immediately in front of the second transfer position on the paper transport path serve as, for example, registration rollers for adjusting the time at which each sheet of recording paper 5 is to be transported. A paper transport device 58, which may be belt-shaped, is provided between the second transfer device 30 and the fixing device 40. The paper transport device 58 transports the sheet of recording paper 5 that has been transported from the second transfer belt 31 of the second transfer device 30 after the second transfer process to the fixing device 40. A pair of paper discharge rollers 59 are disposed near a paper outlet formed in the housing 1*a*. The pair of paper discharge rollers 59 discharge the sheet of recording paper 5 that has been subjected to the fixing process and transported from the fixing device 40 to the outside of the housing 1*a*.

The image input device 60, which is provided when the image forming apparatus 1 is formed as a color copier, is an image reading device that reads an image of a document 6 having the image information to be printed. The image input device 60 is arranged, for example, above the housing 1*a* as illustrated in FIG. 1. The image input device 60 basically includes a document receiving plate (platen glass) 61, a light source 62, a reflection mirror 63, a first reflection mirror 64, a second reflection mirror 65, an image reading element 66, and an imaging lens 67. The document receiving plate 61 includes, for example, a transparent glass plate on which the document 6 having the image information to be read is placed. The light source 62 irradiates the document 6 placed on the document receiving plate 61 while moving. The reflection mirror 63 receives reflected light from the document 6 and reflects the light in a predetermined direction while moving together with the light source 62. The first and second reflection mirrors 64 and 65 move at a predetermined speed by a predetermined distance with respect to the reflection mirror 63. The image reading element 66 includes, for example, a charge coupled device (CCD) that receives and reads the reflected light from the document 6 and converts the reflected light into an electrical signal. The imaging lens 67 focuses the reflected light on the image reading element 66. Referring to FIG. 1, the document receiving plate 61 is covered by an opening-closing covering part 68.

The image information of the document 6 that has been read by the image input device 60 is input to an image processing device 70, which subjects the image information to necessary image processing. The image input device 60 transmits the read image information of the document 6 to the image processing device 70 as, for example, red (R), green (G), and blue (B) three-color image data (for example, 8-bit data for each color). The image processing device 70 subjects the image data transmitted from the image input device 60 to predetermined image processing, such as shading correction, misregistration correction, brightness/color space conversion, gamma correction, frame erasing, and color/movement edition. The image processing device 70 converts the image signals obtained as a result of the image processing into image signals of the above-described four colors (Y, M, C, and K), and transmits the image signals to the exposure device 13. The image processing device 70 also generates image signals for the two special colors (S1 and S2).

Operation of Image Forming Apparatus

A basic image forming operation performed by the image forming apparatus 1 will now be described.

First, an image forming operation for forming a full-color image by combining toner images of four colors (Y, M, C, and K) by using the four image forming devices 10 (Y, M, C, and K) will be described.

When the image forming apparatus 1 receives command information of a request for the image forming operation (printing), the four image forming devices 10 (Y, M, C, and K), the intermediate transfer device 20, the second transfer device 30, and the fixing device 40 are activated.

In each of the image forming devices 10 (Y, M, C, and K), first, the photoconductor drum 11 rotates in the direction shown by arrow A and the charging device 12 charges the surface of the photoconductor drum 11 to a certain potential with a certain polarity (negative polarity in the first exemplary embodiment). Subsequently, the exposure device 13 irradiates the charged surface of the photoconductor drum 11 with the light LB based on the image signal obtained by converting the image information input to the image forming apparatus 1 into a component of the corresponding color (Y, M, C, or K). As a result, an electrostatic latent image for the corresponding color having a certain potential difference is formed on the surface of the photoconductor drum 11.

After that, each of the developing devices 14 (Y, M, C, and K) supplies the toner of the corresponding color (Y, M, C, or K), charged with a certain polarity (negative polarity), from the developing rollers 141 and 142 to the electrostatic latent image of the corresponding color formed on the photoconductor drum 11. The toner electrostatically adheres to the electrostatic latent image, so that the electrostatic latent image is developed. As a result of the developing process, the electrostatic latent images for the respective colors formed on the photoconductor drums 11 are visualized as toner images of the four colors (Y, M, C, and K) developed with the toners of the respective colors.

When the toner images of the respective colors formed on the photoconductor drums 11 of the image forming devices 10 (Y, M, C, and K) reach the respective first transfer positions, the first transfer devices 15 perform the first transfer process so that the toner images of the respective colors are successively transferred, in a superimposed manner, onto the intermediate transfer belt 21 of the intermediate transfer device 20 that rotates in the direction of arrow B.

In each image forming device 10, after the first transfer process, the pre-cleaning charging device 16 recharges the substances, such as toner, that remain on the surface of the photoconductor drum 11 after the first transfer process. Subsequently, the drum cleaning device 17 cleans the surface of the photoconductor drum 11 by scraping off the recharged substances, and the electricity removing device 18 removes the electricity from the cleaned surface of the photoconductor drum 11. Thus, the image forming device 10 is set to a standby state for the next image forming process.

In the intermediate transfer device 20, the intermediate transfer belt 21 rotates so as to transport the toner images that have been transferred onto the intermediate transfer belt 21 by the first transfer process to the second transfer position. The paper feeding device 50 feeds a sheet of recording paper 5 to the paper transport path in accordance with the image forming process. In the paper transport path, the pair of paper transport rollers 57, which serve as registration rollers, transport the sheet of recording paper 5 to the second transfer position in accordance with the transfer timing.

At the second transfer position, the second transfer device 30 performs the second transfer process in which the toner images on the intermediate transfer belt 21 are simultaneously transferred onto the sheet of recording paper 5. In the intermediate transfer device 20 after the second transfer process, the belt cleaning device 28 cleans the surface of the intermediate transfer belt 21 by removing the substances, such as toner, that remain on the surface after the second transfer process.

The sheet of recording paper 5, onto which the toner images have been transferred by the second transfer process, is released from the intermediate transfer belt 21 and from the second transfer belt 31 and transported to the fixing device 40 by the paper transport device 58. In the fixing device 40, the sheet of recording paper 5 after the second transfer process is guided through the contact portion between the heating rotating body 42 and the pressing rotating body 43 that rotate. Thus, a fixing process (heating and pressing) is performed so that the unfixed toner images are fixed to the sheet of recording paper 5. In the case where the image forming operation is performed to form an image only on one side of the sheet of recording paper 5, the sheet of recording paper 5 that has been subjected to the fixing process is discharged to, for example, a discharge container (not illustrated) disposed outside the housing 1*a* by the paper discharge rollers 59.

As a result of the above-described operation, the sheet of recording paper 5 on which a full-color image is formed by combining toner images of four colors is output.

Next, the case will be described in which special-color toner images are additionally formed by using the developers of the special colors S1 and S2 in the above-described normal image forming operation performed by the image forming apparatus 1.

In this case, first, the image forming devices 10S1 and 10S2 perform an operation similar to the image forming process performed by the image forming devices 10 (Y, M, C, and K). Accordingly, special-color toner images (S1 and S2) are formed on the photoconductor drums 11 of the image forming devices 10S1 and 10S2. Subsequently, similar to the manner in which the toner images of the four colors are processed in the above-described image forming operation, the special-color toner images formed by the image forming devices 10S1 and 10S2 are transferred onto the intermediate transfer belt 21 of the intermediate transfer device 20 in the first transfer process. Then, in the second transfer process, the second transfer device 30 transfers the special-color toner images from the intermediate transfer belt 21 onto the sheet of recording paper 5 together with the toner images of the other colors. Lastly, the sheet of recording paper 5, onto which the special-color toner images and the toner images of the other colors have been transferred in the second transfer process, is subjected to the fixing process performed by the fixing device 40 and discharged to the outside of the housing 1*a*.

As a result of the above-described operation, the sheet of recording paper 5 is output on which the two special-color toner images overlap with a part or the entirety of the full-color image formed by combining the toner images of four colors together.

In the case where the image forming apparatus 1 is equipped with the image input device 60 and serves as a color copier, a basic image forming operation is performed as follows.

That is, in this case, when the document 6 is set to the image input device 60 and command information of a request for the image forming operation (copying) is input, the image input device 60 reads the document image from the document 6. The information of the read document image is subjected to the above-described image processing performed by the image processing device 70, so that the image signals are generated. The image signals are transmitted to the exposure devices 13 of the image forming devices 10 (S1, S2, Y, M, C, and K). Accordingly, each image forming device 10 forms an electrostatic latent image and a toner image based on the image information of the document 6. After that, an operation similar to the above-described image forming operation (printing) is performed and the sheet of recording paper 5 on which an image obtained by combining the toner images together is formed is output.

The image forming apparatus 1 includes a control unit 80 that controls the overall operation including the operations of the image forming devices 10, the intermediate transfer device 20, the second transfer device 30, the fixing device 40, and the paper feeding device 50.

Figure 3:
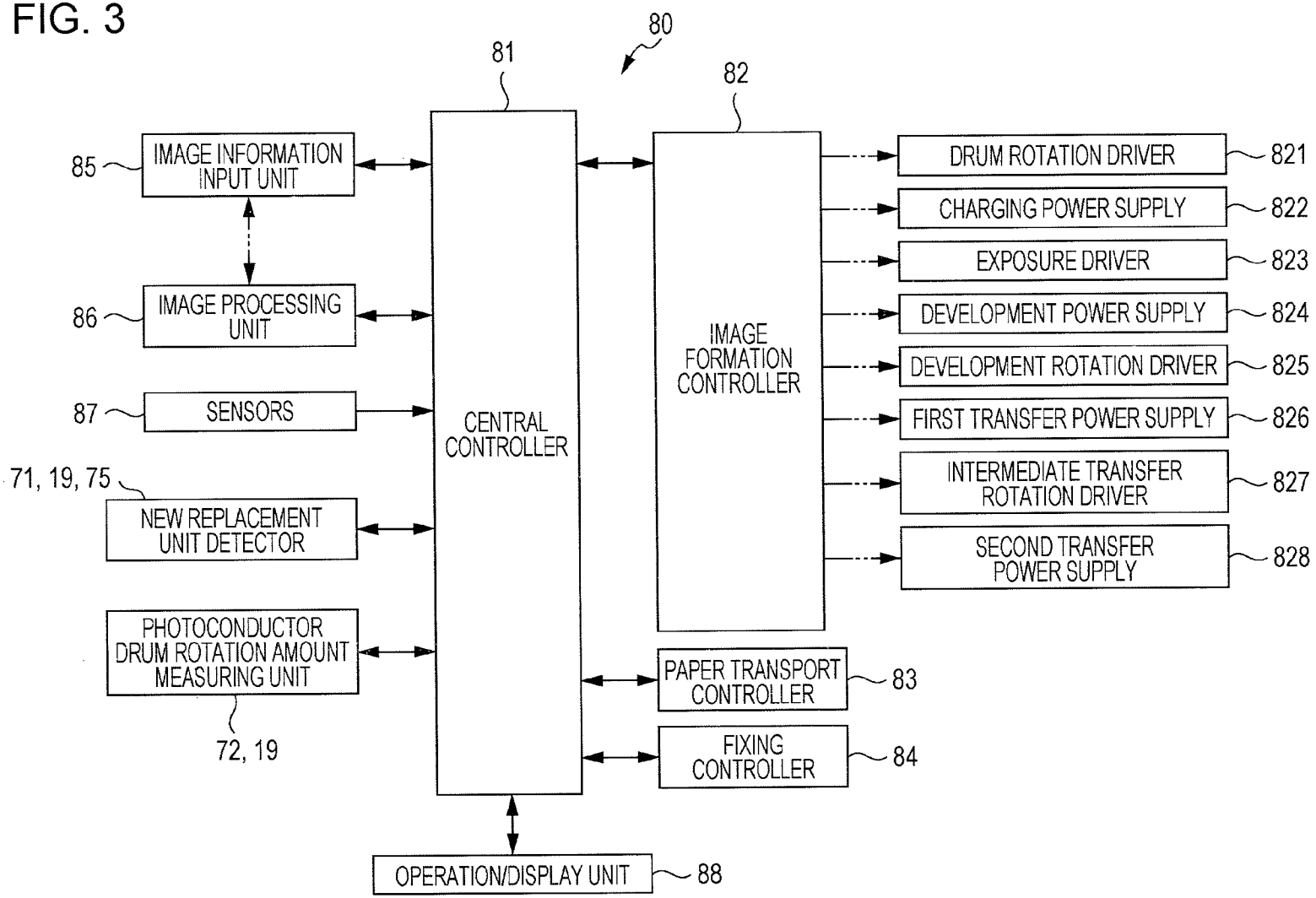
FIG. 3 is a block diagram illustrating the structure of a control system of the image forming apparatus illustrated in FIG. 1.

As illustrated in FIG. 3, the control unit 80 includes a central controller 81 that performs an overall control of the image forming apparatus 1 and low-level controllers, which include an image formation controller 82, a paper transport controller 83, and a fixing controller 84. The image formation controller 82 controls an image forming process and a transfer process performed by the image forming devices 10, the intermediate transfer device 20, and the second transfer device 30. The paper transport controller 83 controls a paper feed process and a paper transport process performed by the paper feeding device 50 and the paper transport path. The fixing controller 84 controls a fixing process performed by the fixing device 40. Each of the central controller 81, the image formation controller 82, the paper transport controller 83, and the fixing controller 84 included in the control unit 80 includes a processing device, a storage element, a control circuit, an external storage, and an input/output device. The operations of the components (elements) included in the image forming apparatus 1 are controlled in accordance with predetermined control programs, data, etc., stored in the storage elements or the external storages.

The central controller 81 of the control unit 80 is connected to and receives necessary information from, for example, an image information input unit (connection communication unit, information reading unit, etc.) 85 to which information of an image to be printed is input; an image processing unit 86 that subjects the input image information to predetermined image processes; sensors 87 that detect various states of the image forming apparatus 1; and an operation/display unit 88 that is operated to select operations and conditions of the image forming apparatus 1 and presents a display. These components input necessary information to the central controller 81. The image formation controller 82 is connected to the following objects that are to be controlled by the image formation controller 82. That is, as illustrated in FIG. 3, the image formation controller 82 is connected to a drum rotation driver 821, a charging power supply 822, an exposure driver 823, a development power supply 824, a development rotation driver 825, and a first transfer power supply 826 that are included in each image forming device 10, an intermediate transfer rotation driver 827 included in the intermediate transfer device 20, and a second transfer power supply 828 included in the second transfer device 30.

Figure 4:
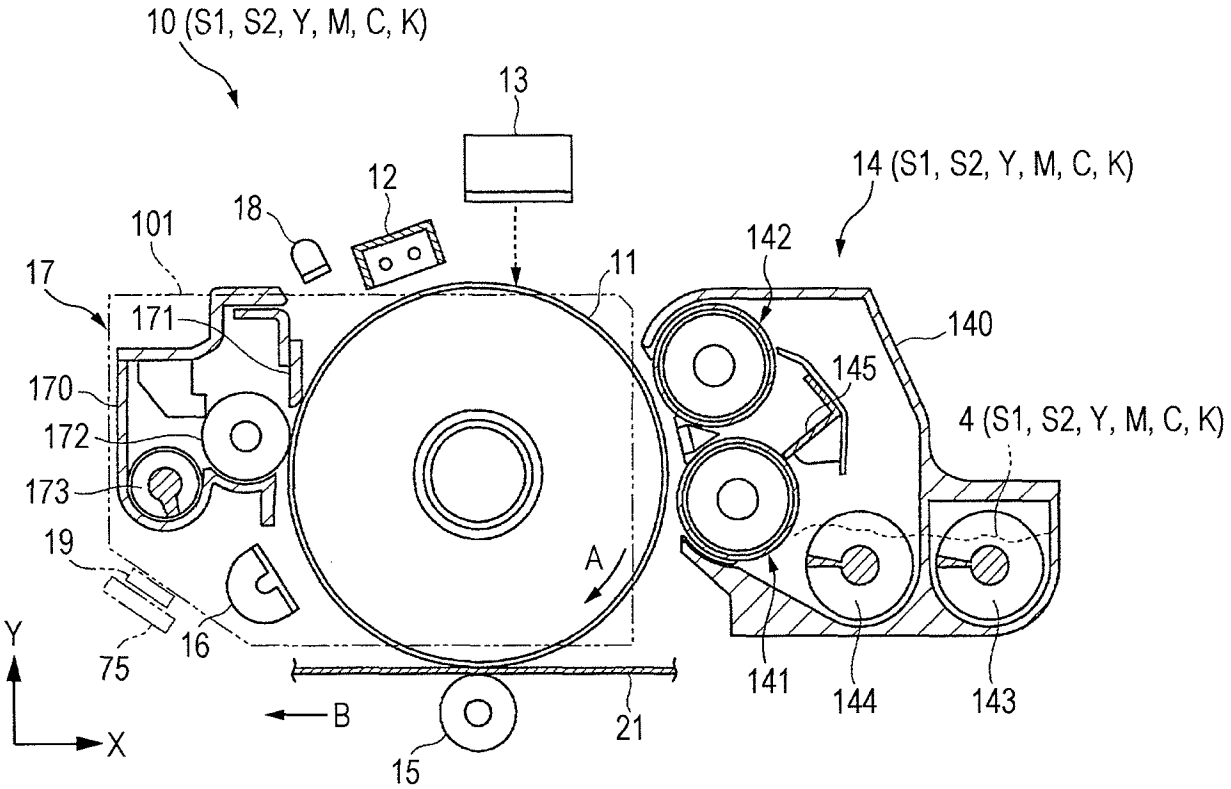
FIG. 4 is a partially sectioned view illustrating a structure added to each image forming device included in the image forming apparatus illustrated in FIG. 1.

In the image forming apparatus 1, as shown by two-dot chain lines in FIG. 4, the photoconductor drum 11, the pre-cleaning charging device 16, and the drum cleaning device 17 included in each of the six image forming devices 10 (S1, S2, Y, M, C, and K) form a replacement unit (for example, a process cartridge) 101 that is attached to the housing 1*a* in a detachable and replaceable manner. The replacement unit 101 is removed from the housing 1*a* when, for example, the photoconductor drum 11 has been damaged or the life thereof has expired. Then, a new replacement unit 101 is attached to the housing 1*a*.

Detailed Structure of Image Forming Apparatus

The detailed structure of the image forming apparatus 1 will now be described.

In the image forming apparatus 1, among the six image forming devices 10 (S1, S2, Y, M, C, and K), the image forming device 10S1 is disposed most upstream in the rotation direction B of the intermediate transfer belt 21, and the remaining image forming devices 10 (S2, Y, M, C, and K) are disposed downstream of the most upstream image forming device 10S1. The developing device 14S1 of the most upstream image forming device 10S1 uses a low-electrostatic-propensity developer 4 (S1) having an electrification performance lower than those of the developers 4 (S2, Y, M, C, and K) used in the developing devices 14 of the downstream image forming devices 10 (S2, Y, M, C, and K).

The amount of charge of the low-electrostatic-propensity developer 4S1 is relatively low when charged by frictional electrification between nonmagnetic toner (particles) and magnetic carrier (particles). The electrification performance (amount of charge) of the developer 4S1, which is relatively low, may be, for example, 0.2 to 0.7 times that of the developers 4 (S2, Y, M, C, and K) used in the developing devices 14 of the image forming devices 10 (S2, Y, M, C, and K) other than the most upstream image forming device 10S1. The electrification performances of the developers may be measured by using a blow-off tribo-tester or the like that measures the amounts of charge of the developers. The low-electrostatic-propensity developer 4S1 may be formed by reducing the amount of external additive particles added to the toner particles to increase the electrification performance or by using toner particles whose properties are adjusted so that the electrification performance thereof is reduced.

In the image forming apparatus 1, to form high-precision images, the developing devices 14 included in the downstream image forming devices 10 (S2, Y, M, C, and K), which are the image forming devices other than the most upstream image forming device 10S1, use high-electrostatic-propensity developers having a relatively high electrification performance as the developers 4 (S2, Y, M, C, and K). The amount of charge of the high-electrostatic-propensity developers 4 (S2, Y, M, C, and K) may be, for example, 60 to 90 μC/g in an environment where the temperature is 21° C. and the humidity is 10% RH when the developers 4 (S2, Y, M, C, and K) are stirred in the respective developing devices 14. The developers 4S1 and 4S2 of special colors used in the developing devices 14S1 and 14S2, respectively, may be developers for forming an image that is difficult or impossible to form with the developers of the above-described four colors (Y, M, C, and K). In the first exemplary embodiment, colorless transparent developers (nonmagnetic toners) that increase the glossiness, black developers having a low glossiness, or developers for increasing the color gamut (O.G.V), for example, may be used.

Figure 5:
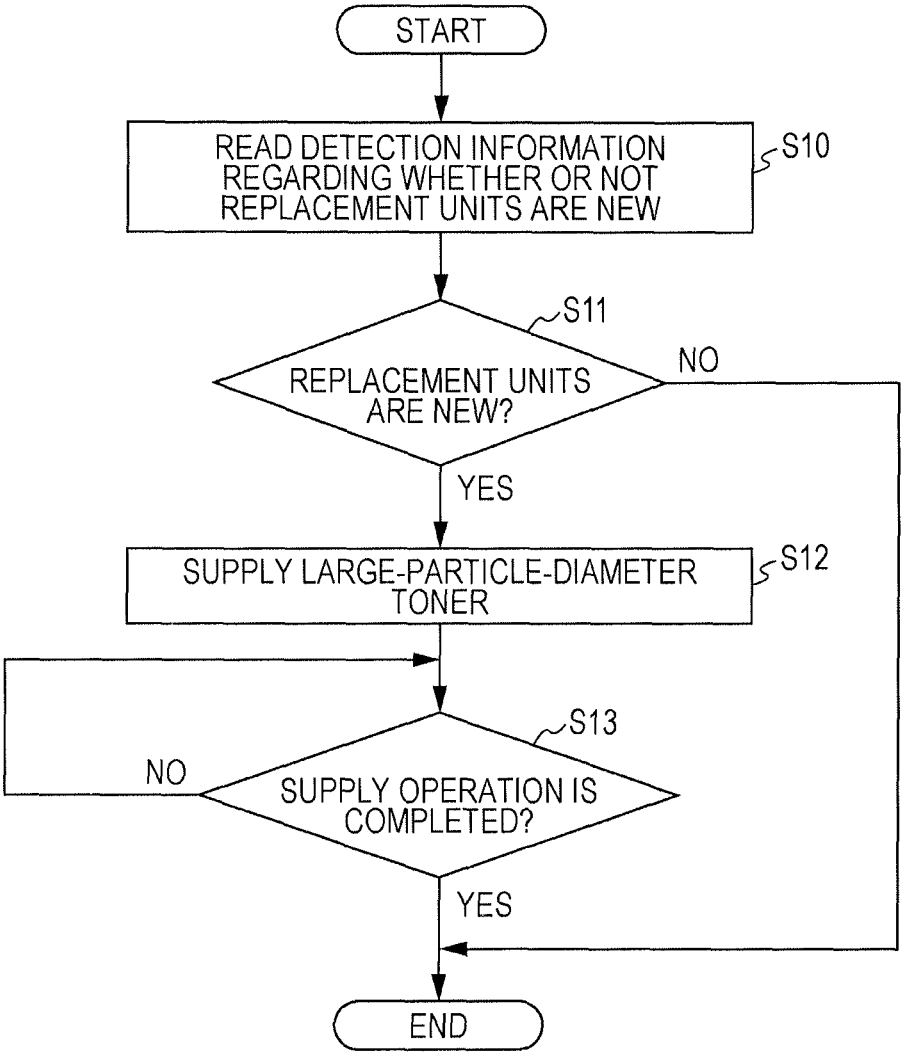
FIG. 5 is a flowchart of a control operation in a control mode for executing a supply operation in a new period.
Figure 6:
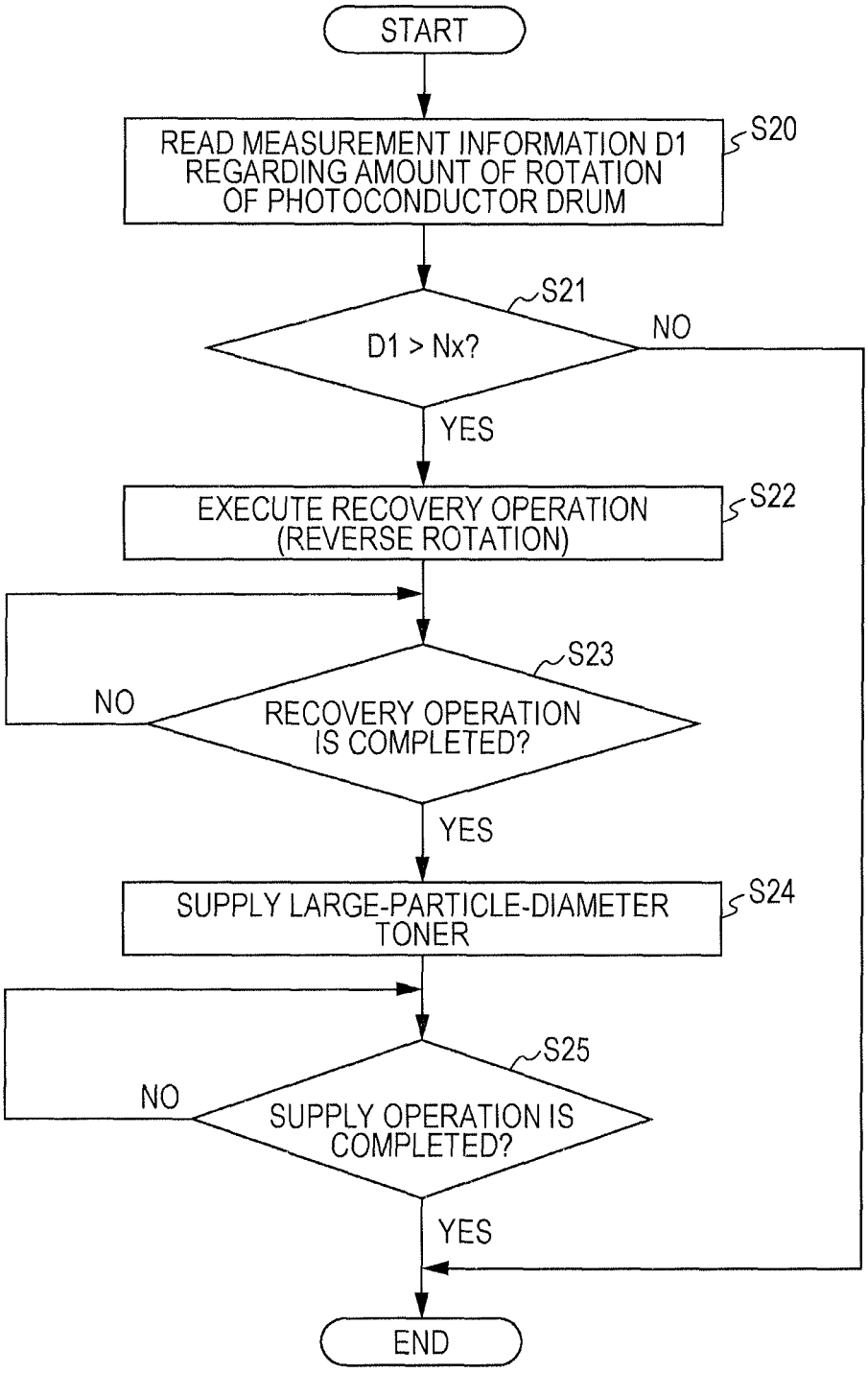
FIG. 6 is a flowchart of a control operation in a control mode for executing the supply operation in a later period.

Referring to FIGS. 5 and 6, the control unit 80 of the image forming apparatus 1 has a control mode for executing a supply operation in which the low-electrostatic-propensity developer 4S1 used in the most upstream image forming device 10S1 is transferred onto the intermediate transfer belt 21 and at least a part of the low-electrostatic-propensity developer 4S1 is reversely transferred onto the photoconductor drum 11 and caused to reach the cleaning plate 171 of the cleaning device 17 in each of the downstream image forming devices 10 (S2, Y, M, C, and K).

In the first exemplary embodiment, the supply operation in this control mode is automatically executed in accordance with a control program. Information such as the control program necessary to execute the supply operation is stored in, for example, the storage element or the external storage of the central controller 81. In the supply operation, first, the most upstream image forming device 10S1 forms a special developer-supplying toner image with the low-electrostatic-propensity developer (toner) 4S1. The special developer-supplying toner image may be, for example, a band-shaped toner image that extends in the axial direction of the photoconductor drum 11. The supply operation is performed until the special developer-supplying toner image formed by the most upstream image forming device 10S1 has passed through all of the first transfer positions of the downstream image forming devices 10 (S2, Y, M, C, and K) and a remaining toner image T2 that has remained instead being reversely transferred is scraped off by the belt cleaning device 28.

FIG. 5 illustrates an example in which the control unit 80 executes the supply operation at least in a new period before the downstream image forming devices 10 (S2, Y, M, C, and K) perform the first image forming process. The first image forming process is the above-described image forming process that is performed for the first time. However, in the case where a control toner image (for example, a patch image) is formed for the first process control in the new period, the image forming process for the process control may be regarded as the first image forming process.

To execute the supply operation in the new period, the image forming apparatus 1 includes a detector 71 (new replacement unit detector, see FIG. 3) that detects whether or not the downstream image forming devices 10 (S2, Y, M, C, and K) are new and have not yet performed the first image forming process. The control unit 80 (central controller 81) determines whether or not it is the new period on the basis of the detection information obtained by the detector 71, and executes the supply operation in the new period.

As illustrated in FIG. 4, the detector 71 may include, for example, a storage element 19 and a read/write device 75. The storage element 19 is provided on each replacement unit 101 at a predetermined position and stores information regarding the replacement unit 101. The read/write device 75 is provided on an attachment section of the housing 1*a* to which the replacement unit 101 is attached and is capable of reading the information stored in the storage element 19 and writing information in the storage element 19 when the replacement unit 101 is attached to the attachment section. The storage element 19 may be, for example, a memory capable of storing information. The information to be stored in the storage element 19 is, for example, the information that the replacement unit 101 is new and has not yet performed the first image forming process. The read/write device 75 is connected to the central controller 81 of the control unit 80 so that the detection information (at least the information that the replacement unit 101 is new) may be transmitted to the central controller 81. After the first image forming process is performed by the downstream image forming devices 10 (S2, Y, M, C, and K), the control unit 80 writes information that the downstream image forming devices 10 are not new in the storage elements 19 on the replacement units 101 of the downstream image forming devices 10.

FIG. 6 illustrates an example in which the control unit 80 additionally executes the supply operation in a later period after the image forming process is performed by the downstream imaging devices 10 (S2, Y, M, C, and K). The later period corresponds to the time at which it is expected that the effect of the above-described supply operation has been reduced after the execution of the supply operation.

To execute the supply operation in the later period, the image forming apparatus 1 includes a measuring unit 72 that measures the accumulated amount of rotation of the photoconductor drum 11 included in each of the downstream image forming devices 10 (S2, Y, M, C, and K). The control unit 80 (central controller 81) determines whether or not the later period has been reached on the basis of the measurement information obtained by the measuring unit 72, and performs the supply operation in the later period.

The measuring unit 72 may count the total number of revolutions of the photoconductor drum 11 in each of the downstream image forming devices 10 (S2, Y, M, C, and K). Specifically, a number-of-revolution measuring device (for example, an encoder) may be used to measure the number of revolutions of each photoconductor drum 11. The number-of-revolution measuring device is connected to the central controller 81 of the control unit 80 so that the measurement information (information of the total number of revolutions of each photoconductor drum 11) may be transmitted to the central controller 81. The control unit 80 determines that the above-described later period has been reached when the total number of revolutions of one of the photoconductor drums 11 exceeds a predetermined threshold Nx. The threshold Nx may be, for example, 10,000. The control unit 80 writes the measurement information obtained by the measuring unit 72 in the storage element 19 on the replacement unit 101 of each of the downstream image forming devices 10 (S2, Y, M, C, and K).

Referring to FIG. 6, the control unit 80 of the image forming apparatus 1 is configured to perform a recovery operation, in which the photoconductor drums 11 included in the downstream image forming devices 10 (S2, Y, M, C, and K) are rotated in a direction A2 opposite to a rotation direction A1 thereof, before the execution of the supply operation in the later period.

To perform the recovery operation, the control unit 80 of the image forming apparatus 1 is configured to perform a control for reversing the rotation direction of a rotation driving device (drum rotation driver 821) that rotates the photoconductor drums 11 included in the downstream image forming devices 10 (S2, Y, M, C, and K). The recovery operation (reverse rotation) is performed at least until the low-electrostatic-propensity developer 4S1 that has accumulated on an end portion of the cleaning plate 171 of the drum cleaning device 17 passes the rotating brush roller 172 of the cleaning device 17 in each of the downstream image forming devices 10 (S2, Y, M, C, and K).

Figure 7A:
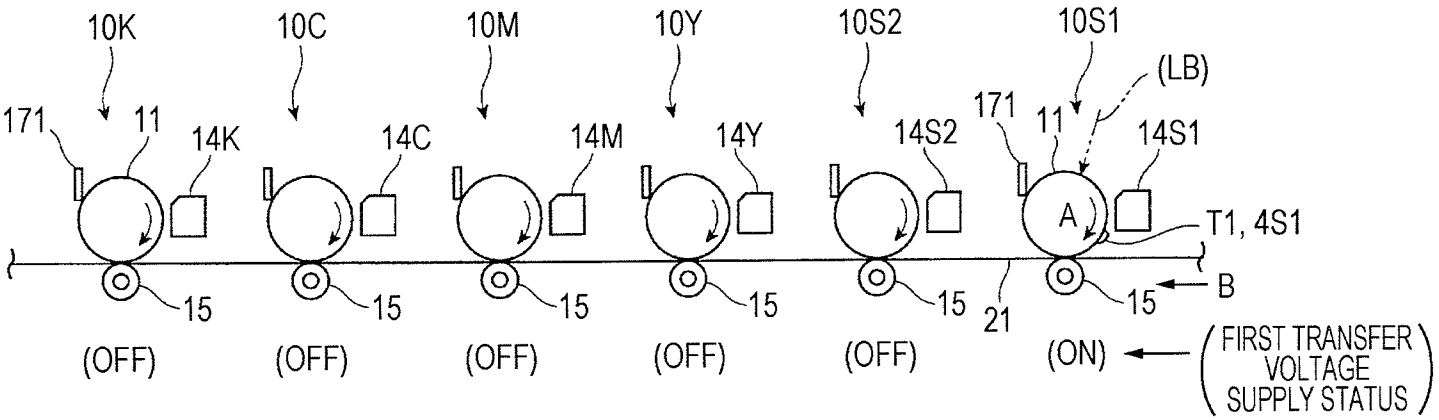

Referring to FIG. 7A, the control unit 80 of the image forming apparatus 1 is configured to perform a control for assisting the reverse transferring of the low-electrostatic-propensity developer 4S1, which forms the special developer-supplying toner image T1, onto the photoconductor drums 11 of the downstream image forming devices 10 (S2, Y, M, C, and K) in the above-described supply operation.

The control unit 80 performs the control for assisting the reverse transferring by stopping (turning off) the supply of the first transfer voltage to the first transfer devices 15 included in the downstream image forming devices 10 (S2, Y, M, C, and K), as illustrated in FIG. 7A. In other words, in the control for assisting the reverse transferring, the first transfer power supply 826 stops supplying the first transfer voltage to the first transfer devices 15 included in the downstream image forming devices 10 (S2, Y, M, C, and K).

Operation of Detailed Structure of Image Forming Apparatus

An operation of the detailed structure of the image forming apparatus 1 will now be described.

(1) Supply Operation Performed in New Period

Referring to FIG. 5, when the power supply of the image forming apparatus 1 is turned on for the first time, the control unit 80 (the central controller 81) reads the detection information regarding whether or not the replacement units 101 of the downstream image forming devices 10 (S2, Y, M, C, and K) are new in step S10 (hereinafter, the step numbers may sometimes be referred to simply as, for example, S10). Then, it is determined whether or not the replacement units 101 are new according to the detection information (S11).

Among the detection information obtained by the detector 71, the detection information regarding the replacement units 101 of the downstream image forming devices 10 (S2, Y, M, C, and K) is read. Specifically, the detection information is read from the read/write device 75 which reads the information regarding whether or not the replacement units 101 are new from the storage elements 19 on the replacement units 101 of the downstream image forming devices 10 (S2, Y, M, C, and K). The time when the power supply is turned on for the first time includes the time when the image forming apparatus 1 is new and is powered on literally for the first time. However, the time when the power supply is turned on afterwards may also be included. In the case where the image forming apparatus 1 includes a detector that detects a replacement of each replacement unit 101, the process of reading the detection information in step S10 may be performed also when control unit 80 receives information that a replacement has been performed.

If it is determined that the replacement units 101 are new according to the detection information in step S11, the control unit 80 performs the supply operation for supplying the low-electrostatic-propensity developer (toner) 4S1 (S12) in the new period. If it is determined that the replacement units 101 are not new according to the detection information in step S11, the control unit 80 ends the process without performing the supply operation. Even when the power supply is turned on for the first time, it is determined that the replacement units 101 are not new if, for example, the replacement units 101 that have already been used are attached by mistake.

The operation of supplying the low-electrostatic-propensity developer (toner) 4S1 is performed by causing the most upstream image forming device 10S1 to form the developer-supplying toner image T1 with the low-electrostatic-propensity developer (toner) 4S1 and causing the downstream image forming devices 10 (S2, Y, M, C, and K) to not form any toner images. In this process, the intermediate transfer device 20 does not activate the second transfer device 30 (does not supply the second transfer voltage), but rotates the intermediate transfer belt 21 and activates the belt cleaning device 28. The paper feeding device 50 and the fixing device 40 are set to a standby state, and are not caused to perform the paper feeding process or the fixing process.

The most upstream image forming device 10S1 performs a process similar to the above-described image forming process (charging, exposure, development, and first transfer processes) except the electrostatic latent image to be formed by the exposure device 13 is changed to an electrostatic latent image for forming the developer-supplying toner image. Accordingly, as illustrated in FIG. 7A, the developer-supplying toner image T1 formed of the low-electrostatic-propensity developer 4S1 is formed on the photoconductor drum 11 of the most upstream image forming device 10S1. The developer-supplying toner image T1 may be, for example, a band-shaped solid image (image area percentage is Cin=100%) that extends in the axial direction of the photoconductor drum 11 over the largest area that may be subjected to the developing process. The developer-supplying toner image T1 on the photoconductor drum 11 with the low-electrostatic-propensity developer 4S1 is transferred onto the intermediate transfer belt 21 by the first transfer device 15 in the first transfer process.

As the intermediate transfer belt 21 rotates in the direction shown by arrow B, the developer-supplying toner image T1 that has been transferred onto the intermediate transfer belt 21 successively passes through the first transfer positions of the downstream image forming devices 10 (S2, Y, M, C, and K). In each of the downstream image forming devices 10 (S2, Y, M, C, and K), the photoconductor drum 11 is rotated, and the charging device 12 and the cleaning device 17 are activated as in a normal image forming process. However, as illustrated in FIG. 7A, the supply of the first transfer voltage to the first transfer devices 15 is stopped (turned off). Accordingly, the developer-supplying toner image T1 on the intermediate transfer belt 21 does not receive the electrostatic force for the first transfer process when it passes through the first transfer positions. Therefore, as illustrated in FIG. 7B, a part of the low-electrostatic-propensity developer 4S1 that forms the developer-supplying toner image T1 is reversely transferred onto the photoconductor drum 11 of each of the downstream image forming devices 10 (S2, Y, M, C, and K) by the effect of pressure.

Figure 7B:
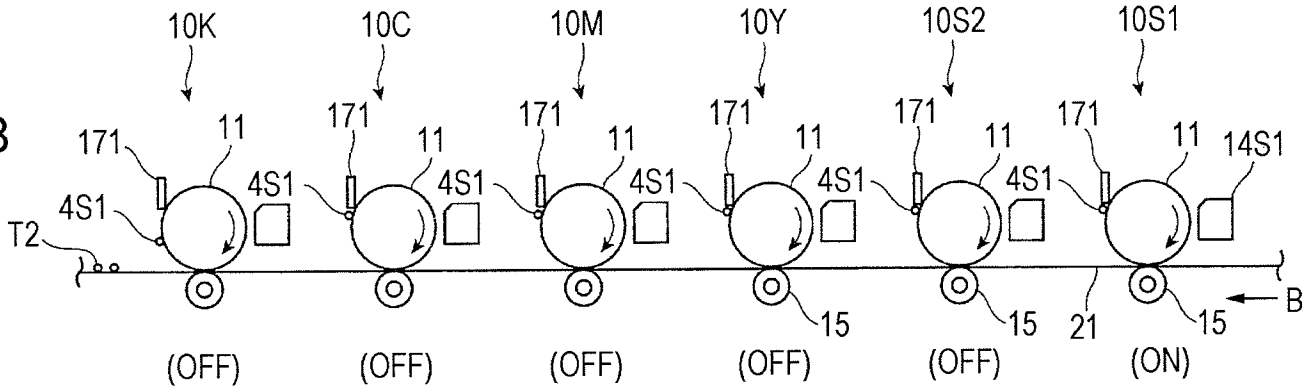

Subsequently, in each of the downstream image forming devices 10 (S2, Y, M, C, and K), the low-electrostatic-propensity developer 4S1 that has been reversely transferred onto the photoconductor drum 11 is transported as the photoconductor drum 11 rotates, and reaches the region in front of the cleaning plate 171 of the cleaning device 17, as illustrated in FIG. 7B. As a result, as illustrated in the enlarged view of FIG. 8, at least a part of the low-electrostatic-propensity developer 4S1 that has been reversely transferred onto the photoconductor drum 11 accumulates in a space (space that is wedge-shaped in cross section) surrounded by a front end face 171*a* of the cleaning plate 171 that is in contact with the photoconductor drum 11 and the surface of the photoconductor drum 11.

In the operation of supplying the low-electrostatic-propensity developer 4S1, as illustrated in FIG. 7B, a part of the low-electrostatic-propensity developer 4S1 that forms the toner image T1 may remain on the intermediate transfer belt 21 instead of being reversely transferred onto the photoconductor drums 11 of the downstream image forming devices 10 (S2, Y, M, C, and K). In such a case, a toner image T2 formed of the remaining low-electrostatic-propensity developer 4S1 is transported to the belt cleaning device 28 through the second transfer position as the intermediate transfer belt 21 rotates, and is collected by the belt cleaning device 28.

When the supply operation is completed (S13), the special control operation performed by the control unit 80 in the new period is also completed. It is determined that the supply operation has been completed when all of the processes to be performed in the supply operation are completed. For example, the completion is confirmed on the basis of information that the intermediate transfer belt 21 has been stopped.

As a result of the above-described operation, the state in which the low-electrostatic-propensity developer 4S1 is collected in front of the cleaning plate 171 of the cleaning device 17 (state in which a dam of low-electrostatic-propensity toner is formed) (see FIG. 8) is established in each of the downstream image forming devices 10 (S2, Y, M, C, and K) in the new period in which the first image forming process has not yet been performed by the downstream image forming devices 10, that is, by the photoconductor drums 11.

Figure 8:
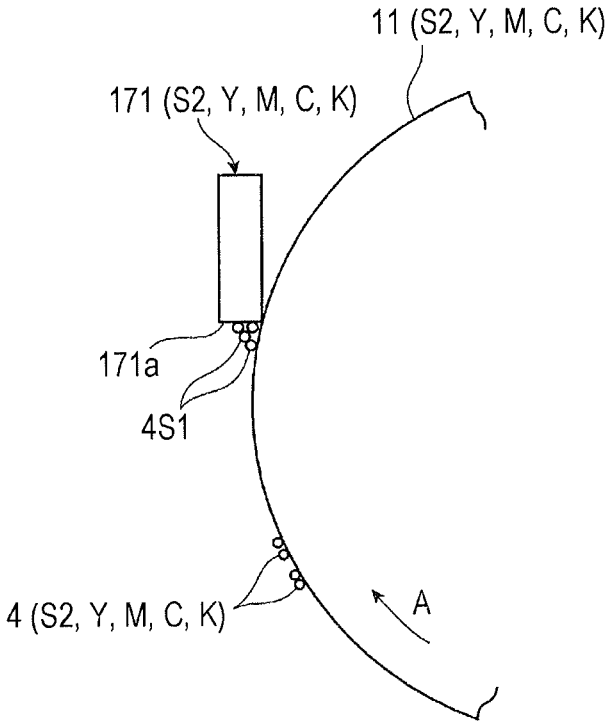
FIG. 8 is an enlarged view illustrating the state of a region in front of a cleaning plate in each of the downstream image forming devices when the supply operation is performed in the new period.
Figure 11A:
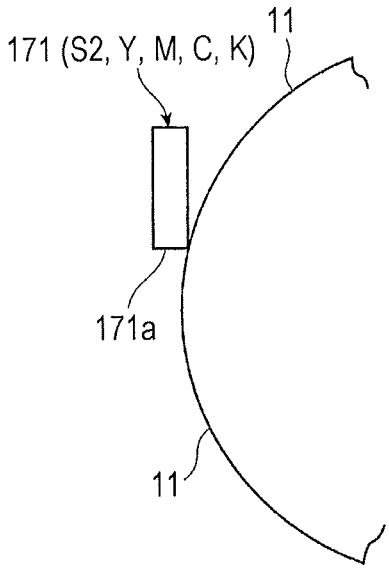
FIG. 11A illustrates the state of a new photoconductor drum and the cleaning plate in each of the downstream image forming devices when the supply operation in the new period is not performed.
Figure 11B:
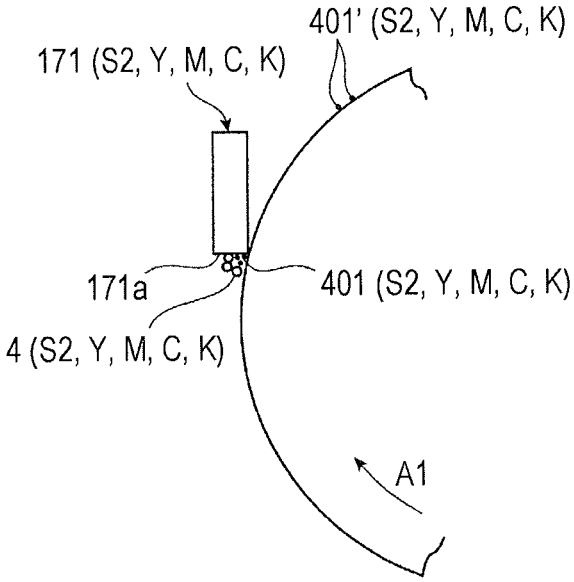
FIG. 11B illustrates the state of the photoconductor drum and the cleaning plate and a cleaning failure that occurs when an additive passes the cleaning plate in each of the downstream image forming devices in the case where the first image forming process is performed without the execution of the supply operation in the new period.

In each of the downstream image forming devices 10 (S2, Y, M, C, and K), when the first image forming process is performed after the above-described supply operation, a part of the high-electrostatic-propensity developer 4 (S2, Y, M, C, K), which has an electrification performance higher than that of the low-electrostatic-propensity developer 4S1, used in the image forming process may reach the drum cleaning device 17 instead of being transferred onto the intermediate transfer belt 21 (see FIGS. 8 and 11B).

In this case, since the low-electrostatic-propensity developer 4S1 is already collected in front of the cleaning plate 171 of the drum cleaning device 17, the high-electrostatic-propensity developer 4 (S2, Y, M, C, K) is blocked by the low-electrostatic-propensity developer 4S1 (toner dam) in front of the cleaning plate 171, and is scraped off by the cleaning plate 171. Therefore, the additive attached to the high-electrostatic-propensity developer 4 (S2, Y, M, C, K) is not easily separated from the toner particles. Even if the additive becomes separated from the high-electrostatic-propensity developer 4 (S2, Y, M, C, K), the separated additive will be collected together with the additive that has been separated from the low-electrostatic-propensity developer 4S1 in front of the cleaning plate 171. Therefore, the separated additive is less likely to be attracted to the peripheral surface of the photoconductor drum 11 by an electrostatic force, and does not easily pass the cleaning plate 171, as described below.

In contrast, as illustrated in FIG. 11A, when each image forming device 10 is new, no developer 4 or the like generally exists in front of the cleaning plate 171 of the drum cleaning device 17 included in the image forming device 10. Therefore, if the downstream image forming devices 10 (S2, Y, M, C, and K) perform the first image forming process without the execution of the above-described operation of supplying the low-electrostatic-propensity developer 4S1 in the new period, as illustrated in FIG. 11B, the high-electrostatic-propensity developer 4 (S2, Y, M, C, K) accumulates in front of the cleaning plate 171 of the drum cleaning device 17 in each of the downstream image forming devices 10 (S2, Y, M, C, and K).

In such a case, a part of an additive 401 attached to the toner particles contained in the high-electrostatic-propensity developer 4 (S2, Y, M, C, K) collected in front of the cleaning plate 171 becomes separated from the toner particles and accumulates in a small space in front of the cleaning plate 171 that is wedge-shaped in cross section and near the peripheral surface of the photoconductor drum 11. The amount of charge of the separated additive 401 is often relatively large since the amount of charge of the developer 4 is relatively large, and therefore a relatively large electrostatic attraction force tends to be applied between the peripheral surface of the photoconductor drum 11 and the additive 401. As a result, a part 401' (S2, Y, M, C, K) of the separated additive 401 passes the cleaning plate 171 (see FIG. 11B).

When a part 401' (S2, Y, M, C, K) of the additive 401 of the high-electrostatic-propensity developer 4 passes the cleaning plate 171, the following image defect may occur, particularly when an image having a certain pattern is repeatedly formed in a previous operation and then a different image is formed in a subsequent operation.

Figure 12A:
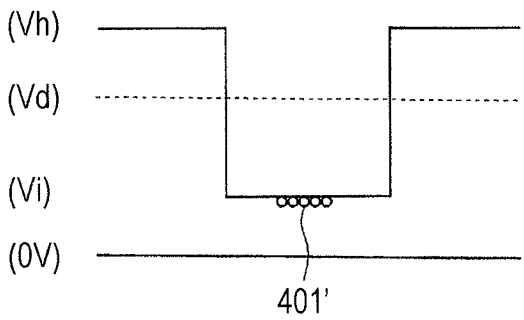
FIG. 12A illustrates a potential model of a developing step of an image forming operation performed after an additive contained in a high-electrostatic-propensity developer has passed the cleaning plate.
Figure 12B:
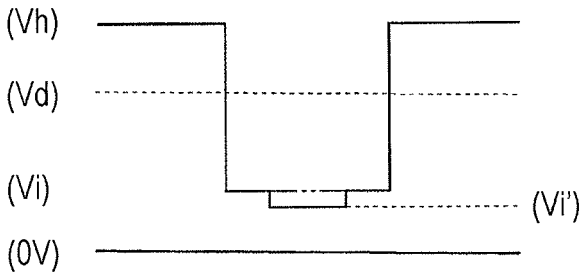
FIG. 12B illustrates the manner in which the additive has been removed in the developing step illustrated in FIG. 12A and a latent image potential is changed in the potential model.
Figure 13A:
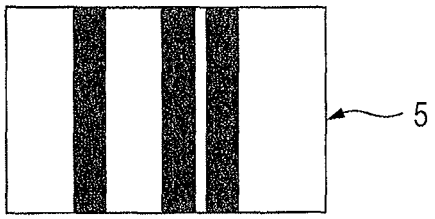
FIG. 13A illustrates an example of an image that is repeatedly formed in a previous operation.

Referring to FIGS. 12A and 12B, the additive 401' adheres to the peripheral surface of the photoconductor drum 11 and accumulates in a region that corresponds to the image that has been repeatedly formed in the previous operation (FIG. 12A). The additive 401' comes into contact with and is scraped off by magnetic brushes formed of the developer 4 on the developing rollers 141 and 142 of the developing device 14 in a developing process of an image to be formed in the subsequent operation (FIG. 12B). A latent-image potential is reduced from Vi to Vi' in the region in which the additive 401' has accumulated, and a larger amount of developer 4 adheres to the photoconductor drum 11 in the region in which the latent-image potential is Vi' than in other areas. As a result, a so-called continuous image formation ghost occurs, which is an image defect in which an image formed in the subsequent operation appears as if a part of an image formed in the previous operation is mixed therein. The developing potential model illustrated in FIGS. 12A and 12B is an example in which a reversal development is performed. In FIGS. 12A and 12B, Vh represents a charge potential and Vd represents a developing voltage. FIG. 13A illustrates an example of an image (striped pattern) formed on the sheet of recording paper 5 in the previous operation.

Figure 13B:
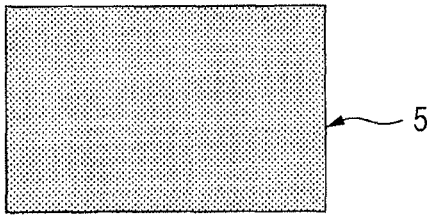
FIG. 13B illustrates an example of an image formed in a subsequent operation.
Figure 13C:
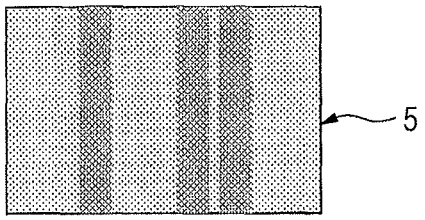
FIG. 13C illustrates an image defect (continuous image formation ghost) in which the image formed in the previous operation is superimposed on the image formed in the subsequent operation.

FIG. 13B illustrates an example of an image (half-tone) expected to be formed on the sheet of recording paper 5 in the subsequent operation. FIG. 13C illustrates an example of the continuous image formation ghost (dark regions correspond to a ghost image) formed in the subsequent operation.

In the case where the above-described supply operation is performed in the new period, the low-electrostatic-propensity developer 4S1 is supplied to the region in front of the cleaning plate 171 of the drum cleaning device 17 of the new photoconductor drum 11. Therefore, the additive contained in the high-electrostatic-propensity developer 4 (S2, Y, M, C, K) does not easily pass the cleaning plate 171 as in the case where supply operation is not performed, and the occurrence of the above-described continuous image formation ghost is reduced.

(2) Supply Operation Performed in Later Period

Referring to FIG. 6, in the image forming apparatus 1, when a predetermined reading time is reached after the execution of the above-described supply operation in the new period, the control unit 80 (the central controller 81) reads measurement information D1 regarding the amount of rotation of the replacement unit 101 in each of the five image forming devices 10 (S2, Y, M, C, and K) (S20). Then, it is determined whether or not the amount of rotation exceeds a threshold Nx according to the detection information D1 (S21). The reading time of the measurement information D1 is set to, for example, a time at which the rotation of the photoconductor drum 11 is stopped.

Among the measurement information obtained by the measuring unit 72, the measurement information regarding the photoconductor drum 11 of each of the downstream image forming devices 10 (S2, Y, M, C, and K) is read. Specifically, the measurement information obtained by the measuring unit 72 that measures the amount of rotation of the photoconductor drum 11 of each of the downstream image forming devices 10 (S2, Y, M, C, and K) (information stored in the storage unit of the control unit 80 or the storage element 19 of each replacement unit 101) is read.

If it is determined that the value based on the measurement information D1 exceeds the threshold Nx in step S21, the control unit 80 performs a control for executing the recovery operation and the supply operation in the later period (S22 and S24). If it is determined that the value based on the measurement information D1 does not exceed the threshold Nx in step S21, the control unit 80 ends the process without performing the recovery operation and the supply operation.

Figure 9A:
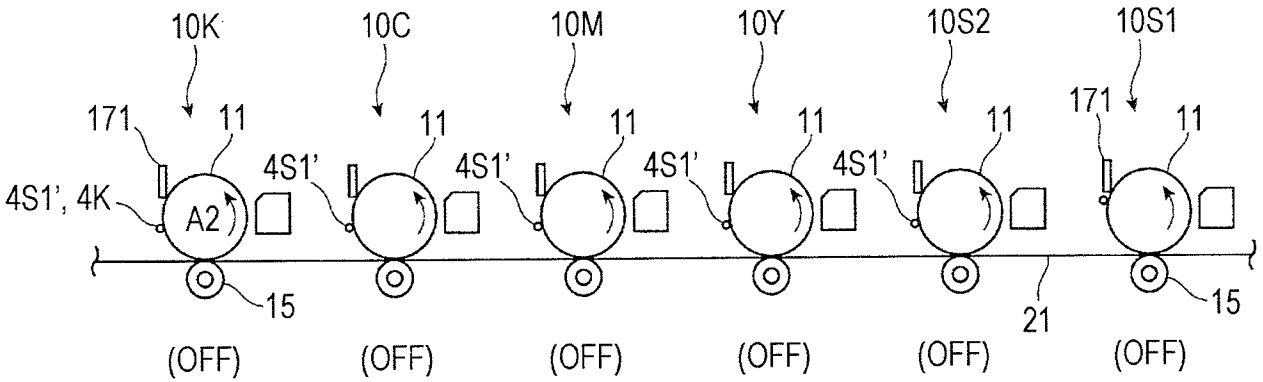

As illustrated in FIG. 9A, the recovery operation is performed by rotating the photoconductor drums 11 included in the downstream image forming devices 10 (S2, Y, M, C, and K) by a predetermined amount in the direction A2 opposite to the rotation direction A1 in a normal operation (reverse rotation). The amount of reverse rotation may be such that a part of each photoconductor drum 11 that has been in contact with the cleaning plate 171 of the corresponding drum cleaning device 17 at least passes the rotating brush roller 172 and stops in the body 170 of the drum cleaning device 17. Specifically, the amount of reverse rotation may be 1/18 of the circumference of the photoconductor drum 11 (amount corresponding to 15° to 20° in terms of the angle around the center of the photoconductor drum 11). Although it is not necessary to rotate the photoconductor drum 11 of the most upstream image forming device 10S1 in the reverse direction, it may be rotated in the reverse rotation together with the photoconductor drums 11 of the downstream image forming devices 10 (S2, Y, M, C, and K).

Figure 10A:
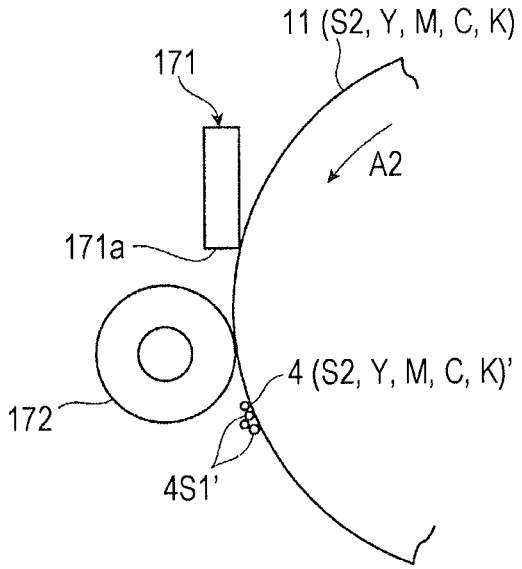
FIG. 10A illustrates the state of the photoconductor drum and the cleaning plate in each of the downstream image forming devices when the reverse rotation is performed before the supply operation in the later period.

As a result of the recovery operation, in each of the downstream image forming devices 10 (S2, Y, M, C, and K), the low-electrostatic-propensity developer 4S1', which has been collected in front of the cleaning plate 171 of the drum cleaning device 17 after the supply operation in the new period, and the high-electrostatic-propensity developer 4 (S2, Y, M, C, K) are moved away from the cleaning plate 171, as illustrated in FIG. 10A. The low-electrostatic-propensity developer 4S1' and the high-electrostatic-propensity developer 4 pass the rotating brush roller 172 of the drum cleaning device 17 and stop at a position inside or slightly outside the body 170 of the drum cleaning device 17. As a result, the space in front of the front end face 171*a* of the cleaning plate 171 of the drum cleaning device 17 becomes free from the developer including the low-electrostatic-propensity developer 4S1 and is refreshed.

After the recovery operation is completed, the supply operation in the later period is performed (S23 to S24). It is determined that the recovery operation has been completed when the rotation driving device of the photoconductor drum 11 in each of the downstream image forming devices 10 (S2, Y, M, C, and K) has finished rotating the photoconductor drum 11 in the reverse direction by the predetermined amount.

Figure 9B:
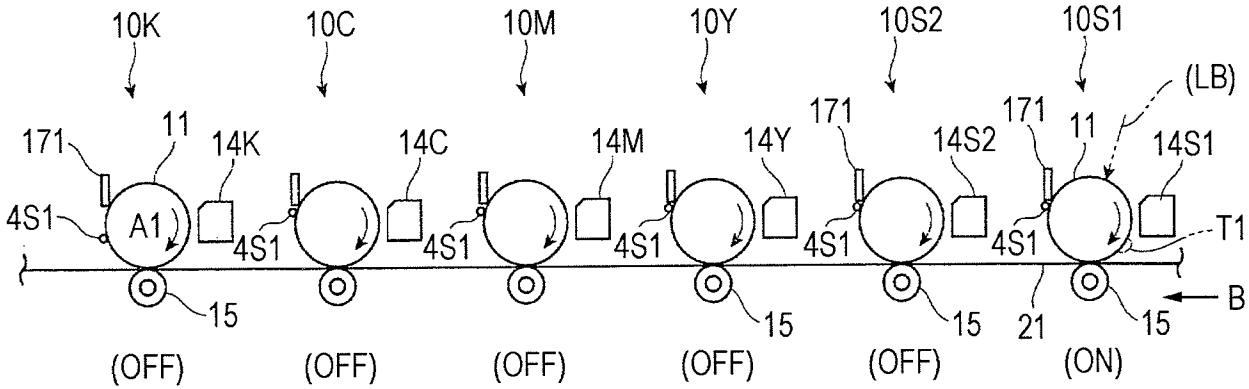

The supply operation for supplying the low-electrostatic-propensity developer (toner) 4S1 in the later period is similar to the above-described supply operation in the new period. Specifically, as illustrated in FIG. 9B, the most upstream image forming device 10S1 forms the developer-supplying toner image T1 with the low-electrostatic-propensity developer 4S1. Subsequently, the developer-supplying toner image T1 is transported by the intermediate transfer belt 21 and caused to successively pass through the first transfer positions of the downstream image forming devices 10 (S2, Y, M, C, and K) so that the low-electrostatic-propensity developer 4S1 is reversely transferred onto the photoconductor drums 11 at the first transfer positions.

As a result of the supply operation in the later period, the low-electrostatic-propensity developer 4S1 that has been reversely transferred onto the photoconductor drum 11 in each of the downstream image forming devices 10 (S2, Y, M, C, and K) is resupplied to the region in front of the cleaning plate 171 of the drum cleaning device 17.

When the supply operation is completed (S25), the special control operation performed by the control unit 80 in later period is also completed. The completion of the supply operation is confirmed on the basis of, for example, information similar to that used to confirm the completion of the supply operation in the new period.

Figure 10B:
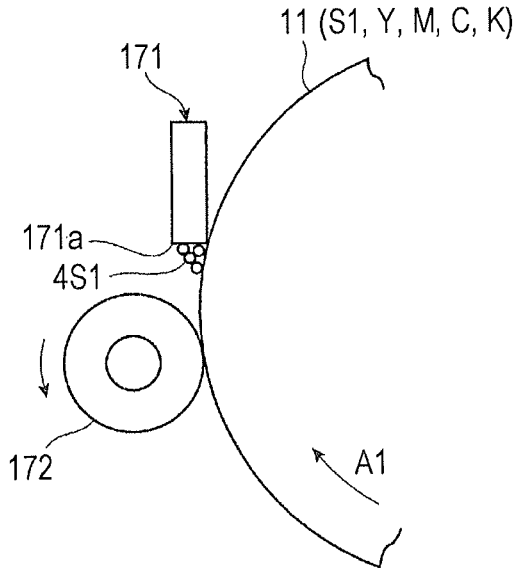
FIG. 10B illustrates the state of the photoconductor drum and a cleaning plate in each of the downstream image forming devices when the supply operation in the later period is performed after the reverse rotation.

As a result, as illustrated in FIG. 10B, new low-electrostatic-propensity developer 4S1 is resupplied to the space surrounded by the front end face 171*a* of the cleaning plate 171 that has been subjected to the recovery operation and the surface of the photoconductor drum 11, and the state in which a dam of low-electrostatic-propensity toner is formed is reestablished. The old low-electrostatic-propensity developer 4S1' that has been moved in the recovery operation is scraped off by the rotating brush roller 172 of the drum cleaning device 17 and removed. Alternatively, a part of the old low-electrostatic-propensity developer 4S1' may return to the region in front of the cleaning plate 171.

Here, assume that the image forming process is performed after the supply operation in the later period. In each of the downstream image forming devices 10 (S2, Y, M, C, and K), even when a part of the high-electrostatic-propensity developer 4 (S2, Y, M, C, K) used in the image forming process reaches the drum cleaning device 17, the low-electrostatic-propensity developer 4S1 that has been resupplied to the region in front of the cleaning plate 171 of the drum cleaning device 17 is appropriately collected in front of the cleaning plate 171. Therefore, the high-electrostatic-propensity developer 4 (S2, Y, M, C, K) is blocked by the low-electrostatic-propensity developer 4S1 (toner dam) that has been newly supplied to the region in front of the cleaning plate 171. Accordingly, the high-electrostatic-propensity developer 4 (S2, Y, M, C, K) is mostly scraped off by the cleaning plate 171 of the drum cleaning device 17, and is collected in the body 170 of the drum cleaning device 17.

Figure 14A:
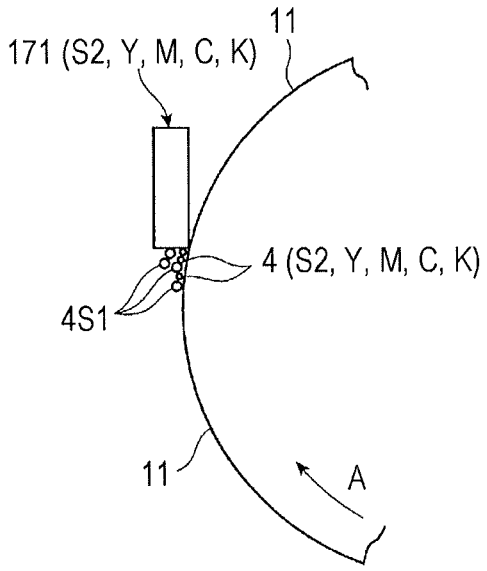
FIG. 14A illustrates the state of a new photoconductor drum and a cleaning plate in each of the downstream image forming devices in the case where the image forming process is performed after the execution of the supply operation in the new period.
Figure 14B:
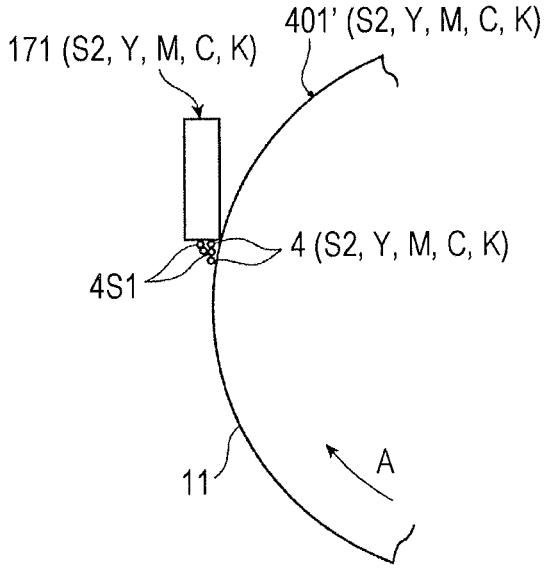
FIG. 14B illustrates the state of the new photoconductor drum and the cleaning plate in each of the downstream image forming devices in the case where the image forming process is continuously performed from the state illustrated in FIG. 14A without the execution of the supply operation in the later period.

In contrast, in the case where the supply operation is not performed in the later period after the execution thereof in the new period, the low-electrostatic-propensity developer 4S1 that has been collected in front of the cleaning plate 171 of the drum cleaning device 17 in each of the downstream image forming devices 10 (S2, Y, M, C, and K) in the supply operation in the new period is gradually scrapped off by the cleaning plate 171, and the amount thereof gradually decreases. As a result, as illustrated in FIGS. 14A and 14B, the low-electrostatic-propensity developer 4S1 cannot be appropriately or sufficiently provided in front of the cleaning plate 171 of the drum cleaning device 17, and the high-electrostatic-propensity developer 4 (S2, Y, M, C, and K) cannot be reliably blocked by the low-electrostatic-propensity developer 4S1. Therefore, a part 401' of the additive 401 contained in the high-electrostatic-propensity developer 4 (S2, Y, M, C, K) may pass the cleaning plate 171 (see FIG. 14B). In other words, the effect of suppressing the cleaning failure (suppressing the additive contained in the high-electrostatic-propensity developer from passing the cleaning plate) achieved by the supply operation in the new stage is reduced, and the continuous image formation ghost occurs.

When the supply operation is performed in the later period as described above, the low-electrostatic-propensity developer 4S1 is resupplied and appropriately collected in front of the cleaning plate 171 of the drum cleaning device 17 in each of the downstream image forming devices 10 (S2, Y, M, C, and K). Therefore, unlike the case in which the supply operation is not performed in the later period, the cleaning failure is continuously suppressed. The reliability and stability of the effect of continuously suppressing the cleaning failure achieved by the supply operation in the later period may be increased by performing the recovery operation prior to the supply operation in the later period.

In the image forming apparatus 1, the low-electrostatic-propensity developer 4S1 supplied in the above-described supply operation is colorless and transparent. Therefore, even if the low-electrostatic-propensity developer 4S1 passes the cleaning plate 171 of the drum cleaning device 17 in each of the downstream image forming devices 10 (S2, Y, M, C, and K) and, in particular, enters the developing device 14 (Y, M, C, K) or is mixed into any of the toner images of the four colors (Y, M, C, K), the image quality is not largely reduced.

The above-described supply operation may be achieved by using the low-electrostatic-propensity developer in the most upstream image forming device 10 among the plural image forming devices 10. Therefore, it is not necessary to, for example, use a mechanism for applying a release agent to the photoconductor drum 11 or arrange an additive-removing device for removing the additive in addition to the drum cleaning device 17 for the photoconductor drum 11 in each of the downstream image forming devices 10. Thus, the supply operations may be achieved with a simple structure at low cost.

When one or more of the replacement units 101 of the downstream image forming devices 10 (S2, Y, M, C, and K) are replaced, each of the newly attached replacement units 101 includes the storage element 19 that stores information showing whether or not the replacement unit 101 is new and information regarding the accumulated amount of rotation of the photoconductor drum 11. Therefore, whether or not the supply operation is to be performed may be determined on the basis of the stored information. In the case where one or more of the replacement units 101 of the downstream image forming devices 10 (S2, Y, M, C, and K) are replaced with new replacement units 101, the above-described supply operation is performed in the new period.

Other Exemplary Embodiments

In the first exemplary embodiment, the most upstream image forming device is set as the image forming device in which the low-electrostatic-propensity developer is used. However, the image forming devices other than the most upstream image forming device may instead be set as the image forming device in which the low-electrostatic-propensity developer is used.

In this case, the developer-supplying toner image T1 is formed by the image forming device which uses the low-electrostatic-propensity developer, and then the intermediate transfer belt 21 is, for example, idly rotated one turn. Subsequently, the developer-supplying toner image T1 is caused to successively pass the image forming devices from the most upstream image forming device so that a part of the developer-supplying toner image T1 is reversely transferred (the reverse transferring is not necessary in the image forming device that uses the low-electrostatic-propensity developer). In this case, a mechanism for moving the belt cleaning device 28 toward and away from the intermediate transfer belt 21 is provided. When the intermediate transfer belt 21 is idly rotated, the belt cleaning device 28 is moved away from the intermediate transfer belt 21 so that the developer-supplying toner image T1 is not scraped off by the belt cleaning device 28. In this case, the operation time of the supply operation is increased and the cost is also increased since the mechanism for moving the belt cleaning device 28 is adopted.

In the first exemplary embodiment, the most upstream image forming device 10S1 uses the colorless transparent developer 4S1 as the low-electrostatic-propensity developer. However, black developer, for example, having a low glossiness may instead be used as the low-electrostatic-propensity developer. In the case where the image forming apparatus 1 does not include the image forming devices 10S1 and 10S2 that use developers of special colors, among the image forming devices 10 (Y, M, C, and K) for the four colors, the image forming device 10K that uses black developer having a low glossiness may be used as the image forming device that uses the low-electrostatic-propensity developer. In other words, the black developer may be used as the low-electrostatic-propensity developer.

Although the recovery operation is always performed before the supply operation in the later period according to the first exemplary embodiment, the supply operation in the later period may sometimes or always be performed without performing the recovery operation in advance. For example, the supply operation in the later period may be performed without performing the recovery operation in advance for the first several times, and then be performed always after performing the recovery operation.

Although the measurement information of the amount of rotation of the photoconductor drum 11 in each of the downstream image forming devices 10 is used as the information for determining whether or not the later time has been reached, other measurement information may instead be used. For example, the accumulated number of sheets subjected to the image forming operation, the accumulated value of image density (accumulated pixel count), or the accumulated operation time for which the rotating brush roller 172 of the cleaning device 17 has been rotated may be used.

In addition, in the first exemplary embodiment, the supply operation in the new period may be performed by a manufacturer or a dealer at the time of, for example, shipping inspection of the image forming apparatus 1. In such a case, when the image forming apparatus 1 for which the supply operation in the new period has already been performed at the time of, for example, shipping inspection is installed in a location designated by the user (buyer) and used for the first time, it may be determined that the supply operation in the new period has already been performed and the supply operation may be started from that in the later period. Alternatively, the supply operation may be started from that in the new period. In this case, the information showing that the replacement units are new may be left unchanged even after the supply operation in the new period is performed at the time of, for example, the shipping inspection.

Even when the supply operation in the new period is performed at the time of shipping inspection so that the low-electrostatic-propensity developer 4S1 accumulates and forms a toner dam in front of the cleaning plate 171 of the drum cleaning device 17 in each of the downstream image forming devices 10 (S2, Y, M, C, and K), there is a possibility that the toner dam will be degraded (for example, damaged or reduced in size) owing to the influence of vibration or the like during transportation of the image forming apparatus 1 to the location of installation thereof. In such a case, an appropriate toner dam may be formed again by performing the supply operation in the new period at the location of installation, and cleaning failure may be prevented at the initial stage of use.

According to the first exemplary embodiment, in the supply operation, the supply of the first transfer voltage is stopped in the downstream image forming devices 10 (S2, Y, M, C, and K) to assist the reverse transferring of the low-electrostatic-propensity developer 4S1. Alternatively, however, the first transfer voltage may be reduced compared to that in a normal image forming process, or a voltage having a polarity opposite to that of the first transfer voltage in the normal transferring operation may be applied to increase the efficiency of reverse transferring.

The number of image forming devices 10 included in the image forming apparatus 1 is not limited to six, and may, of course, instead be two to five or seven or more.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image forming devices arranged along a line, each image forming device comprising a developer and forming a developer image with the developer on a surface of a latent image carrier that rotates in a rotation direction, transferring the developer image onto an intermediate transfer member, and cleaning the surface of the latent image carrier by bringing at least a plate-shaped cleaning member into contact with the surface of the latent image carrier after the transferring of the developer image and scraping off the developer that remains on the surface of the latent image carrier after the transferring of the developer image;

the intermediate transfer body that rotates so as to successively pass through transfer positions of the latent image carriers of the image forming devices and that carries and transports the developer images transferred onto the intermediate transfer body from the latent image carriers; and a controller that controls operations of the image forming devices and the intermediate transfer body, wherein the developer comprised and used in one of the image forming devices is a developer having an electrification performance lower than electrification performances of the developers comprised and used in the other image forming devices, and wherein the controller has a control mode for executing a supply operation in which the developer comprised and used in the one of the image forming devices is transferred onto the intermediate transfer body and at least a part of the developer comprised and used in the one of the image forming devices is reversely transferred onto the latent image carriers of the image forming devices other than the one of the image forming devices and caused to reach the respective plate-shaped cleaning members.

2. The image forming apparatus according to claim 1, wherein the controller is configured to execute the supply operation at least in a new period before the image forming devices other than the one of the image forming devices perform an image forming process for the first time.

3. The image forming apparatus according to claim 2, wherein at least the image forming devices other than the one of the image forming devices are detachable and replaceable, wherein the image forming apparatus further comprises a detector that detects whether or not the image forming devices other than the one of the image forming devices are new and have not yet performed the image forming process for the first time, and wherein the controller is configured to execute the supply operation in the new period by using detection information obtained by the detector.

4. The image forming apparatus according to claim 2, wherein the controller is configured to additionally execute the supply operation in a predetermined later period after the image forming process has been performed by the image forming devices other than the one of the image forming devices.

5. The image forming apparatus according to claim 4, wherein the controller is configured to execute a recovery operation, in which the latent image carriers of the image forming devices other than the one of the image forming devices are rotated in a direction opposite to the rotation direction, before the execution of the supply operation in the later period.

6. The image forming apparatus according to claim 4, further comprising:

a measurement unit that measures an accumulated amount of rotation of each of the latent image carriers of the image forming devices other than the one of the image forming devices, wherein the controller is configured to execute the supply operation in the later period by using measurement information obtained by the measurement unit.

7. The image forming apparatus according to claim 1, wherein the controller is configured to perform a control for assisting the reverse transferring of the developer comprised and used in the one of the image forming devices to the latent image carriers of the image forming devices other than the one of the image forming devices when the controller executes the supply operation.

8. The image forming apparatus according to claim 1, wherein the one of the image forming devices is arranged at a most upstream position among the plurality of image forming devices in a rotation direction of the intermediate transfer body.

9. The image forming apparatus according to claim 1, wherein the other image forming devices, other than the one of the image forming devices, comprise a yellow image forming device, a magenta image forming device, a cyan image forming device, and a black image forming device.

10. The image forming apparatus according to claim 1, wherein the electrification performance of the developer comprised and used in the one of the image forming devices is 0.2 to 0.7 times the electrification performances of the developers comprised and used in the other image forming devices.

11. An image forming apparatus comprising:

a plurality of image forming devices arranged along a line, each image forming device forming a developer image with a developer on a surface of a latent image carrier that rotates in a rotation direction, transferring the developer image onto an intermediate transfer member, and cleaning the surface of the latent image carrier by bringing at least a plate-shaped cleaning member into contact with the surface of the latent image carrier after the transferring of the developer image and scraping off the developer that remains on the surface of the latent image carrier after the transferring of the developer image;

the intermediate transfer body that rotates so as to successively pass through transfer positions of the latent image carriers of the image forming devices and that carries and transports the developer images transferred onto the intermediate transfer body from the latent image carriers; and a controller that controls operations of the image forming devices and the intermediate transfer body, wherein the developer used in one of the image forming devices is a developer having an electrification performance lower than electrification performances of the developers used in the other image forming devices, wherein the controller has a control mode for executing a supply operation in which the developer used in the one of the image forming devices is transferred onto the intermediate transfer body and at least a part of the developer used in the one of the image forming devices is reversely transferred onto the latent image carriers of the image forming devices other than the one of the image forming devices and caused to reach the respective plate-shaped cleaning members, wherein the controller is configured to execute the supply operation at least in a new period before the image forming devices other than the one of the image forming devices perform an image forming process for the first time, and wherein the controller is configured to additionally execute the supply operation in a predetermined later period after the image forming process has been performed by the image forming devices other than the one of the image forming devices.

12. An image forming apparatus comprising:

a plurality of image forming devices arranged along a line, each image forming device forming a developer image with a developer on a surface of a latent image carrier that rotates in a rotation direction, transferring the developer image onto an intermediate transfer member, and cleaning the surface of the latent image carrier by bringing at least a plate-shaped cleaning member into contact with the surface of the latent image carrier after the transferring of the developer image and scraping off the developer that remains on the surface of the latent image carrier after the transferring of the developer image;

the intermediate transfer body that rotates so as to successively pass through transfer positions of the latent image carriers of the image forming devices and that carries and transports the developer images transferred onto the intermediate transfer body from the latent image carriers; and a controller that controls operations of the image forming devices and the intermediate transfer body, wherein the developer used in one of the image forming devices is a developer having an electrification performance lower than electrification performances of the developers used in the other image forming devices, wherein the controller has a control mode for executing a supply operation in which the developer used in the one of the image forming devices is transferred onto the intermediate transfer body and at least a part of the developer used in the one of the image forming devices is reversely transferred onto the latent image carriers of the image forming devices other than the one of the image forming devices and caused to reach the respective plate-shaped cleaning members, wherein the controller is configured to execute the supply operation in a predetermined later period after an image forming process has been performed by the image forming devices other than the one of the image forming devices.

* * * * *